US007735482B2

(12) United States Patent
Meeker

(10) Patent No.: US 7,735,482 B2
(45) Date of Patent: Jun. 15, 2010

(54) COMBUSTION CONTROL SYSTEM

(76) Inventor: John Gordon Meeker, 340 Kent Cornwall Rd., Kent, CT (US) 06757

( * ) Notice: Subject to any disclaimer, the term of this patent is extended or adjusted under 35 U.S.C. 154(b) by 1032 days.

(21) Appl. No.: 11/279,105

(22) Filed: Apr. 9, 2006

(65) Prior Publication Data

US 2006/0231089 A1 Oct. 19, 2006

Related U.S. Application Data

(60) Provisional application No. 60/670,629, filed on Apr. 13, 2005.

(51) Int. Cl.
*F24B 1/187* (2006.01)

(52) U.S. Cl. ..... 126/504; 126/536

(58) Field of Classification Search ..... 126/530, 126/536, 537, 538, 504
See application file for complete search history.

(56) References Cited

U.S. PATENT DOCUMENTS 4,878,478 A * 11/1989 Johnson ..... 126/61
5,611,331 A * 3/1997 Phillips ..... 126/539
5,738,706 A * 4/1998 Swanander et al. ..... 95/14
5,848,931 A * 12/1998 Dortzbach ..... 454/4
6,267,113 B1 * 7/2001 Maust et al. ..... 126/512

* cited by examiner

*Primary Examiner*—Alfred Basichas
(74) *Attorney, Agent, or Firm*—Fish & Richardson P.C.

(57) ABSTRACT

The combustion control system described herein is the top assembly of a combustion chamber. It was developed as part of an efficient wood burning fire place. The assembly presumes that there is some sort of baffle above the fire directing the flames to the front and a non-airtight glass door. The object is to burn cleanly, efficiently, with a minimum of creosote on the glass and with a relatively low cost non-airtight construction. A single damper blade regulates the flue opening, the combustion air supply and dilution air for the chimney. The blade also acts as a deflector to provide a long combustion path and heat extraction. A bimetal element automatically adjusts the damper as the combustion process changes.

2 Claims, 1 Drawing Sheet

COMBUSTION CONTROL SYSTEM

PROVISIONAL PATENT APPLICATION

60/670,629 Apr. 13, 2005 Meeker Woodkiln combustion control system

BACKGROUND

An efficient fire place is herein defined as having an insulated combustion chamber and a large non-gasketed glass door so as to provide a full view of the fire with a high percentage of its heat radiated through the glass. U.S. Pat. No. 4,681,087 illustrates such a construction.

When the Clean Air Act authorized the EPA to regulate wood burning, no such product existed. The resulting regulation required a Woodheater to burn a load of 2×4's and 4×4's spaced 1.5" apart at a very slow rate and defined a fireplace as being very inefficient. Some very clever engineering took place resulting in rather complex, airtight, costly and unattractive units such as described in U.S. Pat. No. 4,766,876.

The overall result was a decline (much greater than anticipated by the regulators) in new wood burning sales except for exempt units such as outdoor boilers. There are no efficient wood burning fire places. The sales of gas and electric fire places have experienced significant growth.

Any fireplace lover knows that the way to get a long burn is with a large "all-nighter" log. To try and slow down a bunch of small logs will result in smoke in the room or dirty glass. An open fire place generally burns cleanly because it has air all around it. A generous controllable air supply is indicated. To be efficient means minimizing the heat sent up the chimney which calls for restricting the flue opening and extracting as much heat as possible before it gets to the flue. To avoid jets of air from leaky doors it is desirable to keep the flue draft as low as possible. This is best done with dilution air. The construction described herein accomplishes these three functions in a user friendly and economical fashion.

DESCRIPTION OF THE INVENTION

Figure 1:
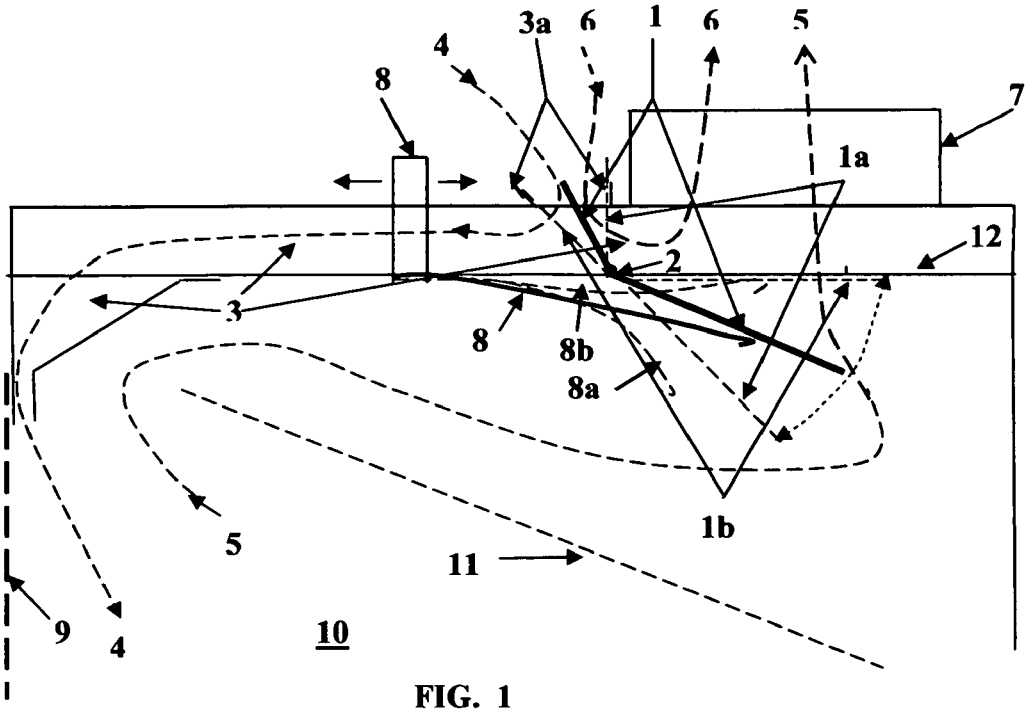

FIG. 1 shows the cross section of a combustion chamber 10 incorporating a flue collar 7, a door 9 and a baffle 11. A damper blade 1 is hinged at point 2 in the top 12 and will rest in the open position 1*a* if left to gravity alone. Air ducts 3 extend to the front above the door and to the rear under the flue collar with an air intake 3*a* above the upper part of the damper. As the damper control 8 is moved toward the flue collar, the damper rotates in a counter clockwise direction to a closed position 1*b*. This action restricts the path of the products of combustion 5, adds dilution air 6 to the flue and restricts combustion air 4 resulting in a relatively low negative pressure in the combustion chamber regardless of chimney construction which in turn permits relatively low cost non-airtight construction. It is also user friendly.

A bimetallic element which bends as temperature increases is shown as part of the damper control. When it is cold 8*a*, the damper is more open to encourage combustion. When it is hot 8*b*, the damper is more closed to slow down combustion. This greatly simplifies the setting of the damper with a new load of fuel.

Figure 2:
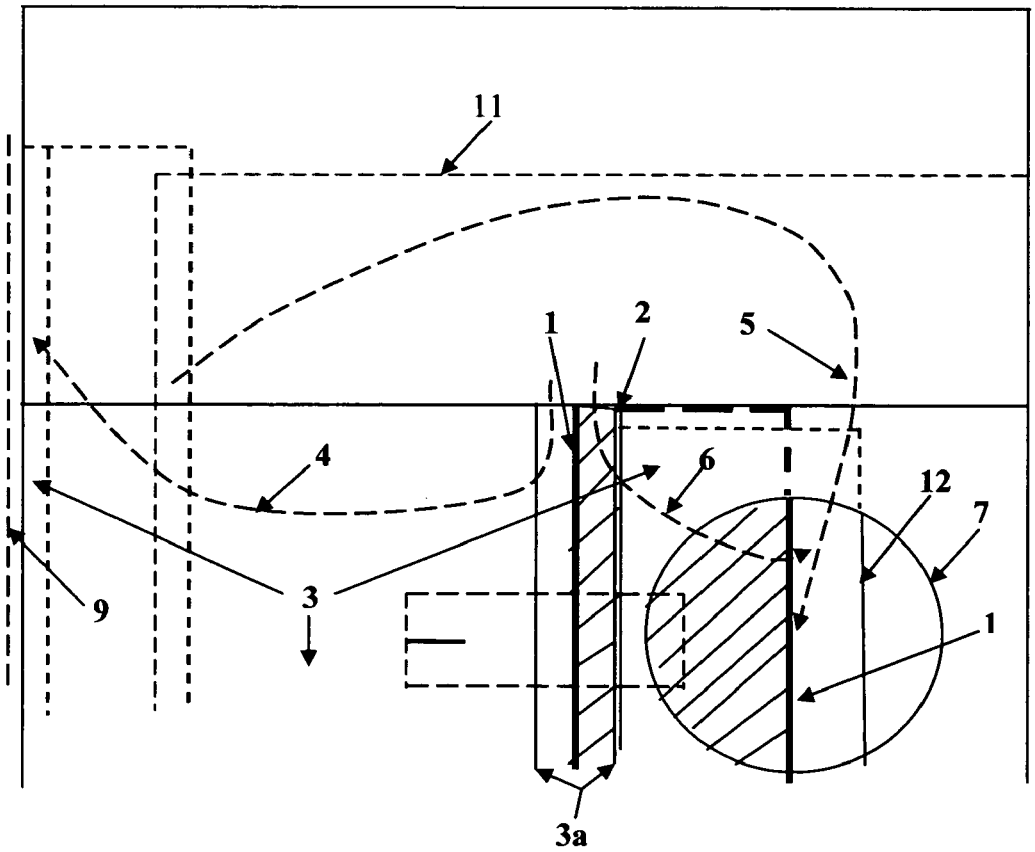

FIG. 2 is a top view of the combustion chamber and illustrates how the bottom portion of the damper acts as a deflector to create a longer path for the products of combustion so as to encourage complete combustion as well as heat extraction before they enter the flue.

I claim:

1. A combustion chamber with a triple acting damper that provides clean burning, user friendly and economical control of a combustion process comprising, combustion chamber incorporating a flue collar, a door and a baffle, a damper blade hinged at the top of the combustion chamber constructed and arranged to rest in an open position if left to gravity alone, air ducts extending to the front of the combustion chamber above the door into the rear of the flue collar, an air intake in the top of the combustion chamber above the damper blade, a damper control constructed and arranged to engage the damper blade to selectively move into a closed position and restrict the products of combustion, restrict combustion air and add dilution air to the flue collar resulting in a relatively low negative pressure in the combustion chamber, the damper control comprising a bimetallic element that causes the damper blade to be more open when cold to encourage combustion and more closed when hot to discourage combustion.

2. A combustion chamber in accordance with claim 1 wherein the damper blade is front hinged at the front of the combustion chamber so that it also serves as a deflector to create a longer path for the products of combustion so as to encourage complete combustion and heat extraction before they enter the flue.

* * * * *